US006121941A

United States Patent [19]

Hirtz

[11] Patent Number: 6,121,941

[45] **Date of Patent: *Sep. 19, 2000**

[54] METHOD AND DEVICE FOR THE CONTROLLING OF MATRIX DISPLAYS

[75] Inventor: Gangolf Hirtz, Niedereschach, Germany

[73] Assignee: Deutsche Thomson-Brandt GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/926,751

[22] Filed: Jul. 26, 1997

Related U.S. Application Data

[63] Continuation of application No. 08/199,321, filed as application No. PCT/EP92/01954, Aug. 26, 1992, abandoned.

[30] Foreign Application Priority Data

Sep. 5, 1991 [DE] Germany ..... 41 29 459

[51] Int. Cl.[7] ..... G09G 5/00

[52] U.S. Cl. ..... 345/3; 345/132; 345/518; 348/441

[58] Field of Search ..... 345/1–3, 55, 213, 345/99, 132, 507, 513, 196, 518; 348/441, 445, 790, 792

[56] References Cited

U.S. PATENT DOCUMENTS

| | | | |
|---|---|---|---|
| 4,855,728 | 8/1989 | Mano et al. | 345/3 |
| 4,990,902 | 2/1991 | Zenda | 345/132 |
| 5,045,939 | 9/1991 | Okayama et al. | 348/445 |
| 5,065,346 | 11/1991 | Kawai et al. | 345/132 |
| 5,083,205 | 1/1992 | Arai | 348/558 |
| 5,103,309 | 4/1992 | Hara | 348/477 |
| 5,218,274 | 6/1993 | Zerda | 345/3 |
| 5,267,045 | 11/1993 | Strommer | 345/441 |
| 5,270,812 | 12/1993 | Richards | 348/390 |
| 5,448,260 | 9/1995 | Zerda et al. | 345/132 |

FOREIGN PATENT DOCUMENTS

| | | |
|---|---|---|
| 0344621 | 12/1989 | European Pat. Off. . |
| 0382567 | 8/1990 | European Pat. Off. . |
| 2179185 | 2/1987 | United Kingdom . |

*Primary Examiner*—Lun-Yi Lao
*Attorney, Agent, or Firm*—Joseph S. Tripoli; Frederick A. Wein

[57] ABSTRACT

Apparatus and method therefor reduces the ratio ft/Za for driving matrix displays where ft represents a signal processing clock frequency and Za represents the number of lines to be displayed on the matrix display. The time interval available for executing signal processing algorithms which drive a matrix display is expanded into time intervals in which a video signal contains no information. The invention is preferably used for driving LCD displays.

6 Claims, 2 Drawing Sheets

METHOD AND DEVICE FOR THE CONTROLLING OF MATRIX DISPLAYS

This is a continuation of application Ser. No. 08/199,321, filed Apr. 7, 1994, now abandoned, which is a 371 of PCT/EP92/01954, filed Aug. 26, 1992.

The invention in question concerns a method for controling a matrix display according to the preamble of the main claim as well as a device, suitable for executing the method according to the invention, according to the preamble of the first device claim.

It is known that for picture reproduction to an increasing extent, not only cathode ray tubes but also so-called matrix indicator units, also called matrix displays, are used. These can be constructed as liquid crystal displays (LCDs), plasma displays or similar.

Matrix displays consist of an arrangement of M*N picture elements, so-called pixels. Here, M is the number of these picture elements per line and N is the number of lines.

The triggering (control) of picture elements is normally carried out line by line, i.e. an analog video signal, containing the information of a picture line, is firstly scanned M times. It is also conceivable that the M scanning values are available already from a previous signal processing.

The scanning values are series-to-parallel converted so that all M scanning values are available at the same time for triggering a display line. The appropriate display line is addressed, whereby the scanning values available in parallel can be written into the appropriate display line.

The clock frequency ft for triggering signal processing devices, which inter alia perform the above-mentioned series-to-parallel conversion and control the matrix display, depends on a number M' of picture elements to be presented per line.

$$ft=M'/Tza \quad (1)$$

Tza is the duration of the video signal to be presented within one line.

It is the object of the present invention to reduce the ratio $$ft/Za \quad (2)$$

where ft is the clock frequency for the signal processing and for controling the matrix display, and Za represents the number of lines to be displayed.

This means that with a predetermined number Za of lines to be presented, the clock frequency ft is reduced or, with a predetermined clock frequency ft, the number Za of lines to be presented is increased.

It is likewise conceivable that both ft and Za are modified such that the ratio specified in equation (2) is reduced.

This task is solved by a generic- (preamble-) type method by means of the features of the main claim, and by a suitable device for executing the method according to the invention having the features of the first device claim.

In accordance with the invention it is proposed to extend a period of time for performing the signal processing algorithms for controling a matrix display into periods of time in which a video signal transmitted from a transmitter or a means of storage contains no picture information. This will preferably be the horizontal blanking period, the vertical blanking period and/or an overwrite period.

In this context performing the signal processing is understood to be inter alia the processing of a video signal and the controling of the matrix display.

The invention is based on the following finding.

For triggering cathode ray tubes, like those used up to now in conventional picture reproduction devices such as television devices, monitors and similar, after writing each individual picture line the electron beam must be guided back to the start of the next picture line. This feeding back requires a certain length of time. It is for this reason that a horizontal blanking period is provided within each line in which there is no active video signal from which the picture to be presented is derived.

Furthermore, with the triggering of a cathode ray tube, after writing the final line of each picture the electron beam must be guided back to the start of the first line. The time required for this is designated the vertical blanking period and taken into account in the video signal to be processed by non-visible flyback lines.

In addition, with cathode ray tubes an overwrite in the horizontal and vertical direction is usually performed because of tolerances which result from the manufacturing process, aging, etc., whereby the picture area to be presented is reduced in both the horizontal and vertical direction.

In contrast to this, when triggering a matrix display consideration of the horizontal and vertical blanking periods in not necessary.

Therefore, these periods are available for the above named signal processing algorithms and the associated clock frequency can be reduced.

This reducing of the clock frequency has, on the one hand, the advantages that the requirements for digital and analog components for the signal processing can be reduced and that high frequency perturbing radiation is also reduced.

On the other hand, the number Za of lines to be presented can be increased without having to perform a corresponding increase in the clock frequency ft.

SUMMARY OF THE INVENTION

Apparatus and method therefor reduces the ratio ft/Za for driving matrix displays where ft represents a signal processing clock frequency and Za represents the number of lines to be displayed on the matrix display. The time interval available for executing signal processing algorithms which drive a matrix display is expanded into time intervals in which a video signal contains no information. The density of picture information to be displayed is determined by the number of picture elements to be controlled and the number of control lines of the matrix display is greater than the number of lines of the video signal to be displayed.

BRIEF DESCRIPTION OF THE DRAWINGS

Further features, advantages and details of the invention are explained in the following embodiment examples by means of the drawing. It shows in.

DETAILED DESCRIPTION OF THE PREFERRED EMBODIMENT

Figure 1:
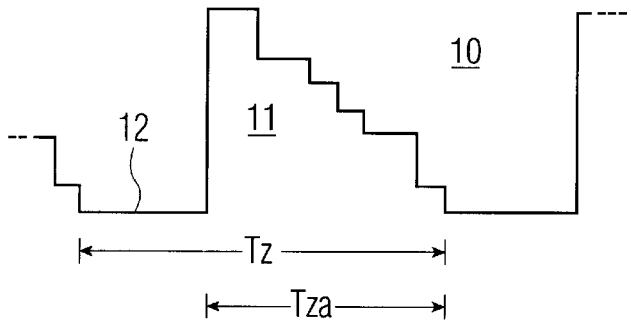
FIG. 1 PRIOR ART
FIG. 1 the progression of a conventional color video signal.

FIG. 1 shows, symbolically, the progression of a video picture line 10, known as such, which is composed of an active part 11 and a non-active part 12. The total duration of the line 10 is Tz, of which the active part 11 occupies the duration Tza.

Figure 2:
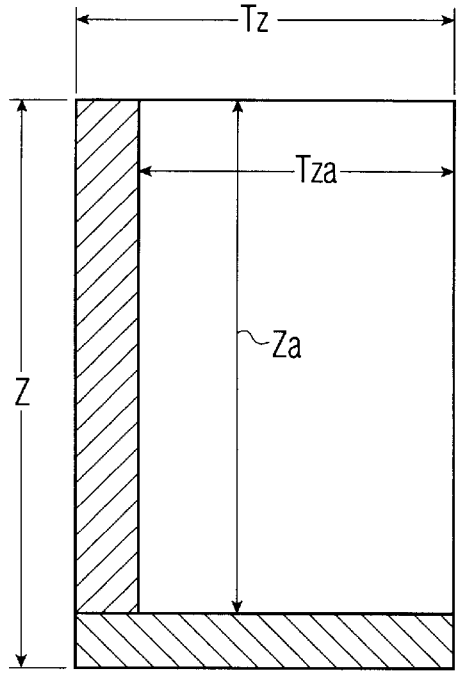
FIG. 2 a temporal picture build-up according to the state of the art.

FIG. 2 shows the temporal build-up of a video picture or, respectively, field with the use of line interlace signals. This consists of a total number Z of lines, of which Za are active, i.e. contain picture information.

Let it be assumed that each of these lines has a progression like that shown symbolically in FIG. 1. The temporal duration of each of the named lines is Tz. If merely such lines are considered as contain picture information, then there is a number Za of them and the length of time for the transmission of the active lines is Tba.

In the period of time shown in simply hatched form in FIG. 2, which results from the difference $$Tz-Tza, \tag{3}$$

the feedback of the electron beam to the start of the following line is carried out in picture reproduction devices with electron beam tubes.

In the period of time shown cross-hatched in FIG. 2, which results from the difference $$Tb-Tba, \tag{4}$$

the feedback of the electron beam to the start of the first line is carried out in picture reproduction devices with electron beam tubes.

The lines indicated in FIG. 2 can also follow a course different from that illustrated in FIG. 1. The essential factor is merely that, besides an active part, a non-active part is provided which, depending on the respective television standard, can contain synchronizing impulses such as "sync", "burst", etc.

Figure 3:
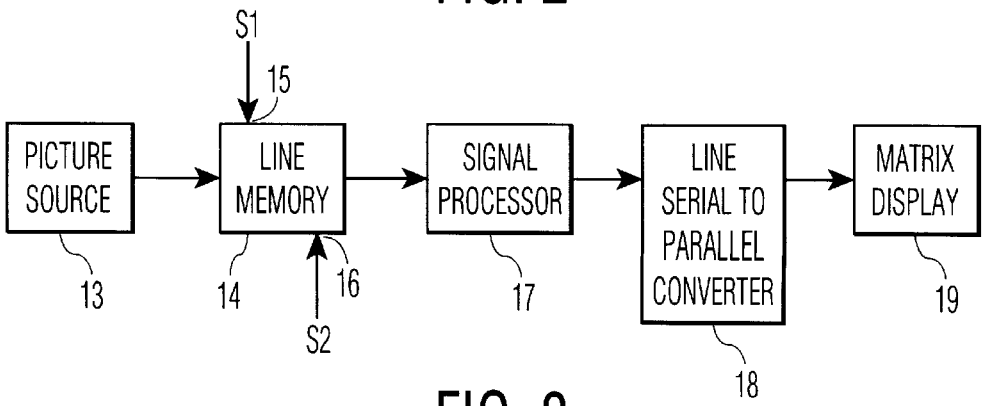
FIG. 3 a first embodiment example according to the device according to the invention, FIG. 4 a second embodiment example according to the device according to the invention, FIG. 5 a temporal picture build-up according to the second embodiment example, FIG. 6 symbolic memorizing and reading procedures according to the second embodiment example.

A device according to a first example embodiment is shown in FIG. 3. A picture source 13, which processes a signal from a recording means or broadcast from a transmitter and comprises, for example, a receiver, a color decoder and an analog-to-digital converter, puts out line-by-line a video signal to the data input of a line memory 14. This comprises a first control input 15 and a second control input 16.

At the first control input 15 a first line control signal S1 is present through which the storing (writing-in) of video line data is controled. At the second control input 16 is a second line control signal S2 through which the reading-out of video line data is controled.

The signal read out from the line memory 14 is sent to a signal processing unit 17. The signal processed by the signal processing unit 17 is sent to a line serial-to-parallel converter 18, the output signal of which triggers a matrix display 19 line-by-line.

Owing to the fact that, as described above, no time periods for the feedback of a beam need be provided for triggering matrix displays, the time periods shown simply hatched in FIG. 2 can, when triggering a matrix display, be additonally used for executing signal processing algorithms and for triggering the matrix display 19.

By just utilizing the horizontal blanking interval Tz−Tza, the time additionally available for image processing algorithms, can by extended by a factor k1 less than or equal to 1.23.

For controling the matrix display 19, an initialization time Ti per line also has to be taken into account. Thus, there results the available duration Tza* for reading-out, processing and displaying a line of $$Tza^* <= Tz - Ti. \tag{5}$$

The number M' of picture elements per line to be presented is in this embodiment example identical with the number M of picture elements per line determined by the geometry of the matrix display.

Consequently, the first line control signal S1 has a first clock frequency ft, the value of which results from $$ft = M/Tza. \tag{6}$$

The second line control signal S2 has a first reduced clock frequency ft', the value of which results from $$ft' = M/Tza^* \tag{7}$$

or, respectively, $$ft' = ft/k1, \tag{8}$$

i.e.

$$Tza^* = Tza^* k1. \tag{9}$$

Thus, the clock frequency required for stages 17, 18 for triggering the matrix display 19 is less for the same number Za of lines to be displayed.

Figure 4:
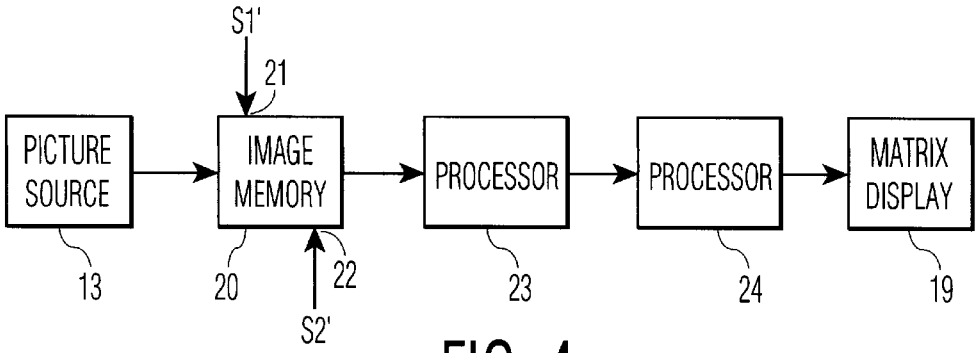

The device of a second embodiment example is shown in FIG. 4. Means which perform the same function as in the first embodiment example in FIG. 3 are designated with the same identifying numbers as in that figure, and these means will only be explained insofar as is necessary for understanding the matter.

The picture source 13 sends its output signal to an image memory 20 which comprises a first control input 21 and a second control input 22.

At the first control input 21 there a first picture control signal S1' is present which controls the storing (writing-in) of video image data. At the second control input 22 there is a second picture control signal S2' which controls the reading-out of video image data.

Various versions can be realized through the progressions of the control signals S1', S2'.

If both the horizontal and the vertical blanking intervals are taken into account, then there results a prolongation of the time available for signal processing of up to 33 per cent, i.e. corresponding to a factor k2 les than or equal to 1.33.

To do this the active signal output by the picture source 13 is written into the image memory 20, in a manner controled by the first picture control signal S1', with the following values:

the clock frequency ft, corresponding to $$ft = M/Tza; \text{ and} \tag{6}$$

a line frequency fz, corresponding to $$fz = Z/Tb; \tag{10}$$

hereby, the picture duration Tb=1/fB, and fB is the picture frequency (normally 50 or, respectively, 60 Hz).

Reading-out of the picture data now takes place, expanded into the vertical blanking gap and in a manner controled by the second picture control signal S2'.

The time available for presenting Za lines is designated Tba'.

$$Tba <= Tba' <= Tb \tag{11}$$

As the time for displaying Za lines has been increased, there results from this a reduction in the line frequency.

As the number Za of lines with picture information is less than the total number Z of lines transmitted by a video signal (see FIG. 2), there results the prolonged duration Tz' for a line to be displayed $$Tz'=Tba'/Za, \quad (9)$$

and therefore, the reduced line frequency ft'

$$fz'=1/Tz'. \quad (12)$$

For triggering the matrix display with one line, there now results the total available line duration Tza+ of $$Tza'<=Tz'-Ti. \quad (13)$$

The reduced clock frequency ft' suitable for this embodiment example is $$ft'=M/Tza'. \quad (14)$$

It should be noted here that the reduced clock frequency ft' is a whole number multiple of the reduced line frequency fz'.

Figure 5:
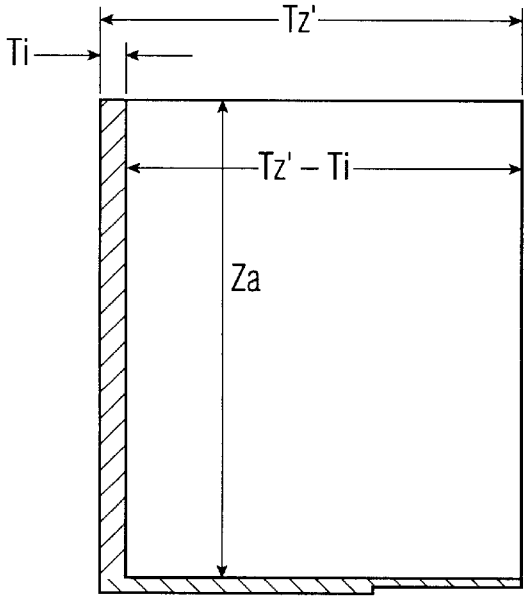

A picture build-up according to the second embodiment example is shown in FIG. 5.

It can be seen that for the picture information which is to be shown, which results from the active parts 11 of each line 10 (see FIG. 1) and the number Za of lines with picture information, almost the entire original picture duration Tb is available.

It should he noted that the time Tb (corresponding to the total framed area of hatched and non-hatched region) is the same in FIG. 2 and FIG. 5.

It can also be seen from FIG. 5 that the time TB' need not be compulsorily divided up into an even number of lines TB/Tz'.

With a variation of this embodiment example, merely the vertical blanking inerval Z–Za (see FIG. 2) is taken into account. Thus, the time $Tza^+$ available for signal processing algorithms increases with respect to that of prior art systems by a factor k3 less than or equal to 1.09.

$$Tz^+=Tz*k3 \quad (15)$$

From this there follows the corresponding clock frequency $ft^+$ $$ft^+=ft/k3. \quad (16)$$

With this variation the first picture control signal S1' is modulated with the clock frequency ft and the second picture control signal S2' with the reduced clock frequency $ft^+$.

If from now on those picture areas which, with cathode ray tubes, are lost through overwriting of the picture area are ignored, then, for a reduced picture content, an even longer time is available for triggering the matrix display 19, whereby a further reduction of the clock frequency is possible.

Figure 6:
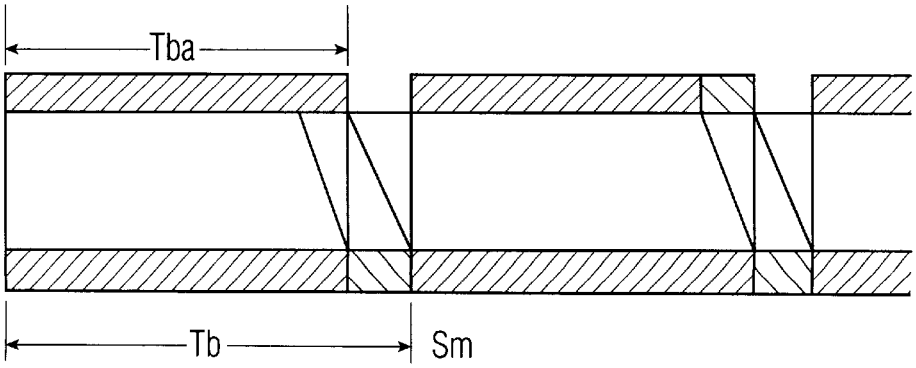

FIG. 6 show, symbolically, storing and reading procedures for the image memory 20 of FIG. 4.

As already mentioned, storing takes place with a higher frequency then reading-out. Picture information is only present within an active picture duration during the total picture duration Tb, and this picture information is stored in this period.

Active picture duration in a system with reduction of the clock frequency by the factor k2=1.33 is understood to be the time corresponding to the non-hatched area in FIG. 2.

In contrast, the reading-out takes place during a timespan which essentially, in particular considering the initialization time Ti, can correspond to almost the entire picture duration Tb.

The size required for the image memory depends on the region in which the picture presentation is enlarged in the vertical direction. This is the region $$Tb-Tba.$$

Taking as a basis a progressive 625-line system with 575 active lines, this corresponds to a maximum region to be stored of up to about 50 lines.

A further embodiment example provides for the clock frequency ft not to be reduced to the extent which was described in the preceding embodiment examples. Instead however, the video information stored in the image memory 20 is to be displayed over a larger number of lines, when compared with the number Za of lines which contain picture information, corresponding to a vertical upward interpolation cf the number of lines Za.

Therefore, for example, an active video image containing picture information can be read into and out of the memory 20 using the same clock frequency.

The periods of time for the beam feedback are additonally available for the processing by stages 23, 24 as well as for display via the matrix display 19. These periods of times can now be used to trigger more lines of the matrix display than is provided by the television standard concerned, leading to a reduction of the visible line structure.

In order to reduce or avoid picture distortions, the picture to be displayed can, for example, have its horizontal dimensions stretched. Sections which, thereby, go beyond the horizontal dimension of the matrix display 19 can be cut off (trimmed).

The following application is also conceivable.

When using a matrix display with, for example, 560 lines, and when processing a video image according to the M standard (US standard) using approx. 482 active lines, it is possible to expand the picture to be displayed to 560 lines.

The result cf this is that the line structure is less visible and also that a possible matrix display with a larger number of lines available can be better utilized. When using an optic constructed in view of the maximum number of lines in the display, there results, through the triggering of the entire matrix display, an increase in the light efficiency.

Further versions of the named embodiment examples may comprise at least one of the following variations:

- for an indirect triggering of the matrix display 19 means of storage can be provided which store the temporally "stretched picture" and the information read out from these serve for a triggering of the matrix display 19;
- the number M' of picture elements to be presented does not correspond to number M of picture elements per line predetermined by the geometry of the matrix display 19. Instead, storing and/or reading-out of the video signal in the line or, respectively, image memory can be carried out with a lower resolution. Using the picture information so obtained neighboring picture elements of the matrix display 19 can be jointly triggered so that this displays a video image with lower resolution over almost its entire area. Furthermore, it is conceivable that the picture information only be fed to part of the matrix display 19 as is the case, for example, with picture-in-picture systems. The vertical resolution can also be similarly reduced;

instead of storing a single video image (or, respectively, parts thereof), several video images can be stored which can subsequently be displayed via several matrix displays or be recorded;

instead of a direct triggering of the matrix display, an indirect triggering is also possible. Direct triggering in this context is understood to be displaying picture information transmitted by the video signal "on-line". With an indirect triggering a recording of the picture information behind memory 14 or, respectively, 20 and later triggering of the matrix display 19 is carried out.

I claim:

1. A method for controlling a matrix display having a multiplicity of picture elements, said matrix display displaying a video signal comprising active portions corresponding to picture information and inactive portions, said method wherein the control of picture elements is carried out line by line, comprising the steps of:

scanning and storing in memory active portions of an input video signal at a first rate which corresponds to the density of picture information contained in the active portions, and reading out from said memory the stored information at a second rate determined by the density of picture information to be displayed and the time available for display comprising active and inactive parts, the density of picture information to be displayed being determined by the number of picture elements to be controlled, the number of control lines of the matrix display being greater than the number of lines of the video signal to be displayed, so that a ratio ft/za is reduced from the ratio required for a cathode ray tube, where ft is a clock frequency for signal processing and for controlling the display, and za represents the number of lines to be displayed.

2. The method according to claim 1 wherein the transmitted video signal corresponds to an M-standard (US-standard).

3. The method according to claim 1 wherein the number of lines of the matrix display to be controlled is 560.

4. Apparatus for controlling a matrix display comprising:

a memory controlled by a first control signal so that active portions of an input video signal having active and inactive portions provided from a picture source containing picture information in the active parts are stored at a first rate which corresponds to the density of picture information contained in the active portions and to the duration of the active portions of the video signal, and is read out by means of a second control signal at a second rate which is determined by the density of picture information to be displayed and from the time available for its display which includes time available for the active and inactive parts, the memory being controllable responsive to signals at control inputs of the memory for controlling the video information stored in the memory, the density of picture information to be displayed being determined by the number of picture elements to be controlled, the control of picture elements being carried out line by line, and the number of control lines of the matrix display being greater then the number of lines of the video signal to be displayed, such that a ratio ft/za is reduced from the ratio required for a cathode ray tube, where ft is a clock frequency for signal processing and for controlling the display, and za represents the number of lines to be displayed.

5. The apparatus according to claim 4 wherein the transmitted video signal corresponds to an M-standard (US-standard).

6. The apparatus according to claim 4 wherein the number of lines of the matrix display to be controlled is 560.

* * * * *